United States Patent [19]

Scott

[11] Patent Number: 4,835,928

[45] Date of Patent: Jun. 6, 1989

[54] COMPOSITE WALL CONSTRUCTION

[76] Inventor: Samuel C. Scott, 4575 Joliet St., Denver, Colo. 80239

[21] Appl. No.: 824,446

[22] Filed: Jan. 31, 1986

Related U.S. Application Data

[63] Continuation of Ser. No. 578,362, Feb. 8, 1984, abandoned.

[51] Int. Cl.[4] ..... E04B 2/00

[52] U.S. Cl. ..... 52/426; 52/434; 52/564

[58] Field of Search ..... 52/415, 417–419, 52/434, 425, 426, 564, 562, 481, 712–715, 378, 235, 508, 743, 565, 379

[56] References Cited

U.S. PATENT DOCUMENTS

| | | | |
|---|---|---|---|
| Re 20,188 | 12/1936 | Simons | 52/426 |
| 905,096 | 11/1908 | Perkins | 52/715 |
| 1,420,478 | 6/1922 | Forbush | 52/426 |
| 1,448,613 | 3/1923 | Bendall | 52/426 |
| 1,495,457 | 5/1924 | Taylor | 52/564 |
| 1,596,404 | 8/1926 | Clouser | 52/595 |
| 1,616,977 | 2/1927 | Koivu | 52/426 |
| 1,620,834 | 3/1927 | Rhodes | 52/425 |
| 1,699,554 | 1/1929 | Wigglesworth | 52/564 |
| 1,924,724 | 8/1933 | Olney | 52/379 |
| 2,029,082 | 1/1936 | Odam | 52/426 |
| 2,116,946 | 5/1938 | Huntington | 52/434 X |
| 2,166,371 | 7/1939 | Reed | 52/426 |
| 2,851,875 | 9/1958 | Astorga | 52/564 |
| 2,919,572 | 1/1960 | Salzi | 52/564 |
| 4,056,904 | 6/1976 | Dawdy | 52/434 X |
| 4,226,061 | 10/1980 | Day, Jr. | 52/122 |
| 4,342,181 | 8/1982 | Truesdell | 52/743 |
| 4,373,314 | 2/1983 | Allan | 52/379 X |
| 4,393,635 | 7/1983 | Long | 52/309.11 |

FOREIGN PATENT DOCUMENTS

| | | | |
|---|---|---|---|
| 289926 | 3/1944 | Switzerland | 52/564 |
| 393969 | 6/1933 | United Kingdom | 52/564 |
| 618030 | 2/1949 | United Kingdom | 52/425 |
| 642289 | 8/1950 | United Kingdom | 52/379 |

*Primary Examiner*—Carl D. Friedman

*Attorney, Agent, or Firm*—James E. Pittenger

[57] ABSTRACT

A composite masonary wall structure is formed of inner and outer wall panels stacked and formed on either side of a reinforcing framework formed in a vertical aligned position. Novel cross-tie brackets are provided to secure the upper edges of each panel in proper position equidistant on either side of the reinforcing frame work and tied securely to this framwork. A hardenable or expandable bonding filler material is introduced into the cavity formed between the panels and reinforcing framework structure to bond the panels and framework securely into a homogeneous structure. The cross-tie brackets allow precise positioning of the wall panels with respect to the framework and securely ties the structure together allowing for rapid construction of a composite masonary wall.

4 Claims, 4 Drawing Sheets

COMPOSITE WALL CONSTRUCTION

This is a continuation of application Ser. No. 578,362 filed 2/8/84 now abandoned.

FIELD OF THE INVENTION

This invention is directed to a composite wall construction formed from a tier of inside and outside panels which are stacked in conjunction with a series of interior columns with the panels held in proper position by a plurality of formed cross ties interconnecting the panels with the columns. The space between the panels surrounding the columns is filled with a hardenable material.

BACKGROUND OF THE INVENTION

The construction industry utilizes many different types of wall construction for buildings. There has been little change in these various types of construction over the past several decades. One of the newer types is the composite wall structure which can be quickly constructed into a completely unitary wall structure.

Most of these prior composite wall structures have been complicated arrangements whereby preformed panels, usually of a large size such as two or three foot by four foot are precast in separate individual molds. An interfitting lip is provided around the peripheral edges of each of the panels whereby individual panels will dovetail together to form a smooth outer surface. These panels are set on edge usually on a base structure and built up in tiers to form the inner and outer surfaces of the wall structure. Reinforcing rods have been placed internally within the space between the panels with spacer blocks and tie wires provided between the panels to hold the panels in a rigid position.

Some of the problems that are encountered with this type of construction is the inability of individuals to easily handle panels of this size and to be able to stack these panels into the usual structure without the use of equipment. Some of these panels have been reduced in overall length to make them more convenient but still when formed from a cementatious material they are still quite heavy to manually manipulate.

Other problems which have been encountered are the intricate network of connections that are required between the panels forming the surfaces to rigidly hold the panels in aligned vertical position and especially when the interstices between the panels is filled with a hardenable material such as an expandable polyurethane foam. The expansion of this material from the bottom when it is poured into the open space creates a considerable upward force on the internal cross members which are holding the panels in position. This force can be quite strong causing the spacer blocks and the ties to be bent and actually separating the individual panels. This excessive force from the expansion can cause the walls to be distorted producing an undesirable result.

On the other hand, the introduction of a cementatious hardenable material which is non-expanding still produces problems in this type of composite wall because of the number of cross members including spacer blocks and tie wires that are usually required. These obstructions make it difficult for the concrete to flow and fill all voids even with the use of vibrators.

The cost of the old type of composite wall construction is quite high from the standpoint that considerable man hours are required to position the panels and then tie and reinforce these panels by means of the tie wires, cross ties, cross members and spacer blocks. Thus, much of the benefit that is expected by the composite wall type of construction is lost due to the time consumed in positioning and reinforcing the panels. In addition, maintaining the old type wall construction in a plumb position without exterior bracing has been previously impossible.

There has been very few arrangements proposed wherein a composite or panel type wall can be utilized in providing an outside facade or cover for an existing wood or masonary structure. It is highly significant that a rigid tie can be utilized for securing the outside panels to the existing surface in order to hold the panels in proper alignment and position. In addition, it is quite impossible to mount the panels directly on the existing structure because of the weight of the individual panels. This additional weight can exceed the load carrying capacity of the existing structure causing the wall to buckle or even collapse. The present invention eliminates these problems by producing a composite wall wherein the entire weight of the panels is supported by the existing or a new foundation structure. Thus, the panels support their own weight and are not directly supported by the existing structure.

Another problem that has existed for many years is the positioning of the individual panels and the maintenance of a straight alignment for the panels with a constant spacing between the inside and outside surfaces. In addition, in most cases significant reinforcement of the wall from a load carrying standpoint has not been provided.

In the present invention, all of these problems have been addressed by building the composite wall around a reinforcing structure which is common in frame-type construction. Thus, metal or wood standard studding is provided as the core for the composite wall produced by the present invention which not only aligns and maintains the wall panel sections but provides reinforcing for the final structure.

INFORMATION DISCLOSURE STATEMENT

The following information refers to the most pertinent patents to which the applicant is aware with respect to the subject matter of the present invention. Although other patents are known to the applicant which deal with concrete wall composite structures, they are believed to be less pertinent than the patents which are discussed here. This section is believed to comply with the applicant's acknowledged duty to inform the Patent Office of any pertinent information of which he is aware.

The patent which issued to W. R. Forbush (U.S. Pat. No. 420,478) shows a composite wall construction utilizing preformed concrete blocks forming the outside and inside panels. The individual blocks have grooves and holes to accommodate a bent rod tie bracket for holding the panels in relative position.

The patent which issued to Rhodes (U.S. Pat. No. 1,620,834) discloses a composite wall utilizing inside and outside panels which are formed with an angular tongue and groove peripheral edge. A stamped metal cross tie bracket is positioned between the tiers of the front and back panels to hold them in relative position while the center space between the panels is filled with a concrete hardenable material. No internal reinforcing structure is provided and the bracket is considerably different from the present invention.

The patent which issued to Day (U.S. Pat. No. 4,226,061) shows a reinforced masonary wall structure. This patent discloses that elongated panels are stacked in tiers to form the inside and outside surfaces of the wall and are held in a spaced predetermined relationship by ties which serve as a web member provided between common reinforcing bars or rods acting as the core of a truss. The ties are arranged in vertical or horizontal alignment and reinforcing rods extend through the ties from one end to the other of the wall or slab. The interior space of the wall can be filled with low density cellular concrete to form a composite wall structure.

The patent which issued to Odam (U.S. Pat. No. 2,029,082) shows a composite wall structure wherein the inside and outside panels are held in position by threaded tie rods which have flat end pieces which are arranged in grooves formed in the horizontal edges of the panels. The end plates of the tie rods serve to align the panels in vertical position. A stamped and bent tie member is also disclosed.

British patent No. 618,030 which issued to Fenna, discloses a composite wall formed from inside and outside panels which are held in position by sheet metal tie members which hold the panels from moving away from each other while a pair of wedge blocks are positioned in the internal space to tension the panels and hold them firmly against the tie rods.

SUMMARY OF THE INVENTION

The present invention concerns a composite wall structure formed of molded inner or outer wall panels or both secured together as a unit by cross tie brackets which hold the panels in proper aligned position incorporating a pre-plumb structure support member. The panels are stacked on one or both sides of a frame work formed by structural members arranged in spaced vertical position to align and support the stacked wall panels. The space between the wall panels can be filled with a hardenable, bonding material which adheres under pressure to the inner roughened surfaces of the preformed panels which secures the panels and reinforcing structure in a rigid composite wall.

The wall structure that is formed is exceedingly strong in all direction and provides an excellent building adjunct for residential, commercial and industrial construction. The wall structure may be provided with an exterior surface panel resistant to weather which can have any desirable outer surface finish including real brick or ceramic tile or the like. The inner panels can be finished to provide any suitable surface decor. A wall thus formed is very strong in compression and can be used as a load bearing member for multi-storied buildings. Depending upon the nature of the materials used, the wall has considerably better insulating qualities than conventional walls of concrete, cinder block, solid brick, brick and frame or the like.

The key to the present wall structure lies in the cross tie members or brackets which are multi-functional. The brackets are formed at each end to closely fit the edge joint structure formed in the upper peripheral edge of each panel. Thus, when the bracket is in position, the panels are held to prevent them from moving either inward or outward.

In addition, a portion of the body of the bracket which is formed from thin sheet material is arranged vertical while the remaining center portion is recessed to fit the width of the columns or studs forming the core or reinforcing structure. The recess is centered between the end sections so that the wall panels will be equally spaced on either side of the reinforcing structure. A plurality of holes are formed along the vertical center portion of the bracket so that a fastener can attach the bracket to the adjacent stud or column. The vertical positioning of the center portion of the bracket is important to minimize the projected horizontal area so that when the interior space formed between the panels is filled with an expandable foam material, the foam will not exert the vertical forces normally found on the conventional cross ties which have been known to raise the cross tie and even distort the finished wall.

The bracket which is described above can also be used to obtain additional results when the panels are used to form a facade on the framework or on an existing structure. In this way the framework or existing wall or building actually forms the reinforcing structure and/or the brackets are cut and bent to provide the predetermined distance between the existing structure and the panels to form the new wall surface. Thus, as previously described the panels are stacked to form either a new exterior or interior wall surface. These panels are spaced from the framework or existing structure which will allow the space to be filled with a hardenable material or expandable insulating foam. One or more of the holes formed in the body of the bracket can be used to attach the bracket securely to the surface of the existing structure. As an alternative the bracket can be attached by any suitable method such as welding.

The new composite wall structure described herein as well as the novel cross tie bracket provides a new and unique structure. This arrangement eliminates the problems as stated above which have been found in the prior art. Thus, this novel invention provides a low cost method of construction which can be rapidly and inexpensively built when compared to the existing arrangements for fabricating concrete or composite walls. In addition, the new composite wall structure as provided in the present invention exhibits considerable physical strength which meets or exceeds similar types of structures and existing building codes and specifications.

It is to be understood that all references made to a specific composite wall structure and cross tie bracket used in that structure and any other variations of this arrangement which utilizes the features which are described herein are to be considered part of this invention.

BRIEF DESCRIPTION OF THE DRAWINGS

Other features and advantages of the present invention will become apparent in the following detailed description of the invention wherein like reference numbers denote the same elements in the accompanying drawings.

DETAILED DESCRIPTION OF THE INVENTION

Figure 1:
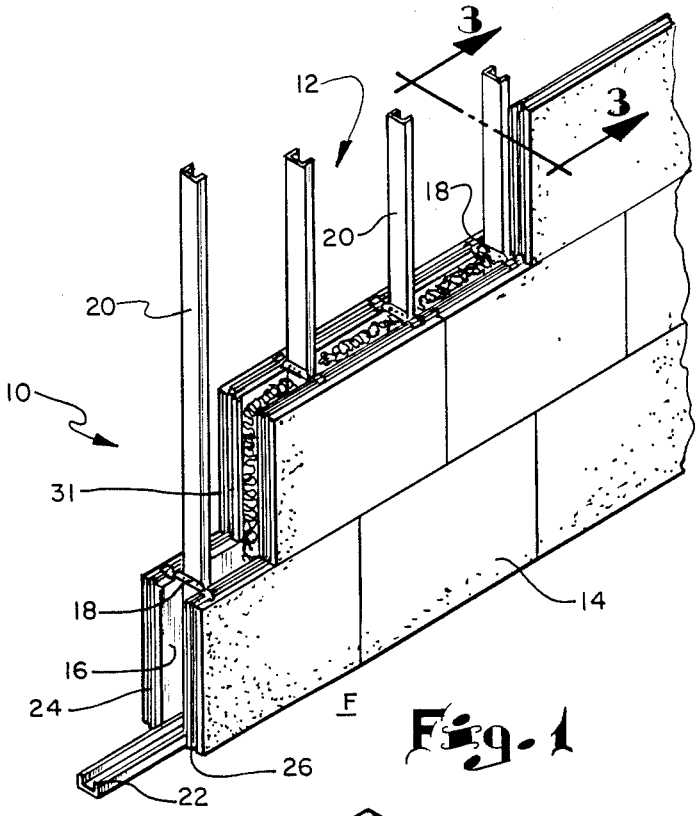
FIG. 1 is a perspective view of a partially completed composite wall according to the present invention.

Turning now more specifically to FIG. 1, the composite wall structure 10 of the present invention is comprised of a framework type reinforcing structure 12, a plurality of outside preformed panels 14 and inside preformed panels 16. The panels either outside or inside 14, 16 can be stacked in any desired arrangement such as parallel, staggered (as shown in FIG. 1) or any other assembly arrangement which is desired. A cross tie bracket 18 is stategically located adjacent each vertical reinforcing stud or member 20 and interconnects the edges of corresponding panels.

The reinforcing structure 12 is fabricated in a conventional sense from a plurality of horizontal and vertical cross members. Usually these members are wooden two by four studs or metal studs formed in a U-shaped channel to suitably resemble and replace the wooden stud. In most industrial and commercial construction the metal studs are utilized because of their price and strength, ease of construction handling and fireproof nature and ease of maintaining plumb. In the construction of most wall structures, a bottom plate 22 is securely fastened to a suitable concrete floor or foundation F. The plate 22 is positioned over the centerline of the intended wall structure. Vertical studs or members are attached to the plate and spacedly positioned to provide the necessary rigidity and strength intended. The ends of the vertical studs are normally attached by a horizontal top cap or plate which holds the vertical studs 20 in proper parallel position and alignment. The studs and caps are fastened together by welding or suitable fasteners (not shown) which will hold the structure in proper position.

Figure 2:
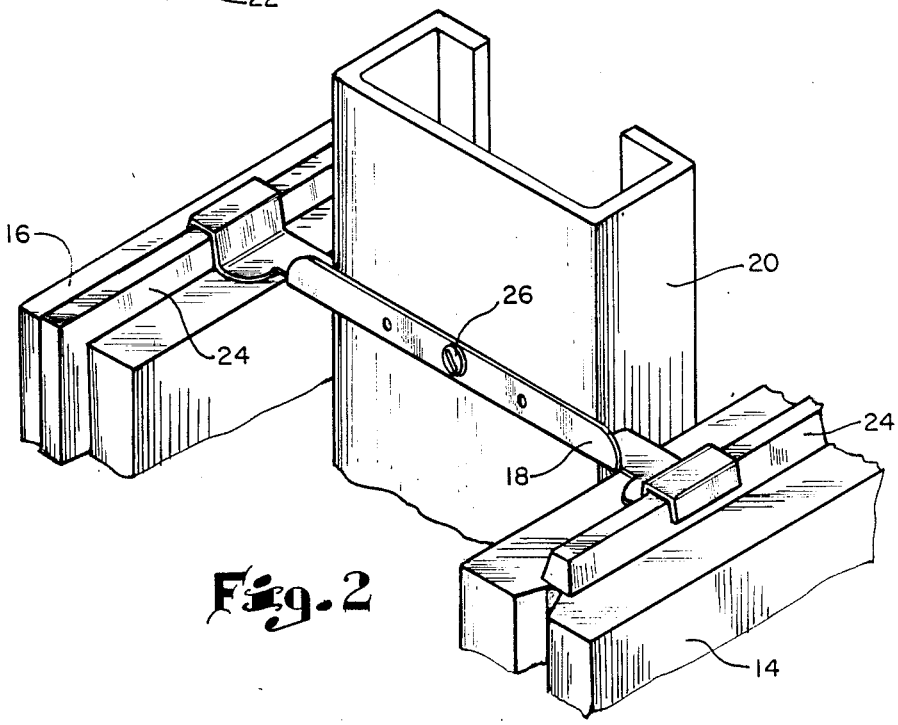
FIG. 2 is an enlarged perspective view showing the cross tie in relation to a reinforcing stud.
Figure 3:
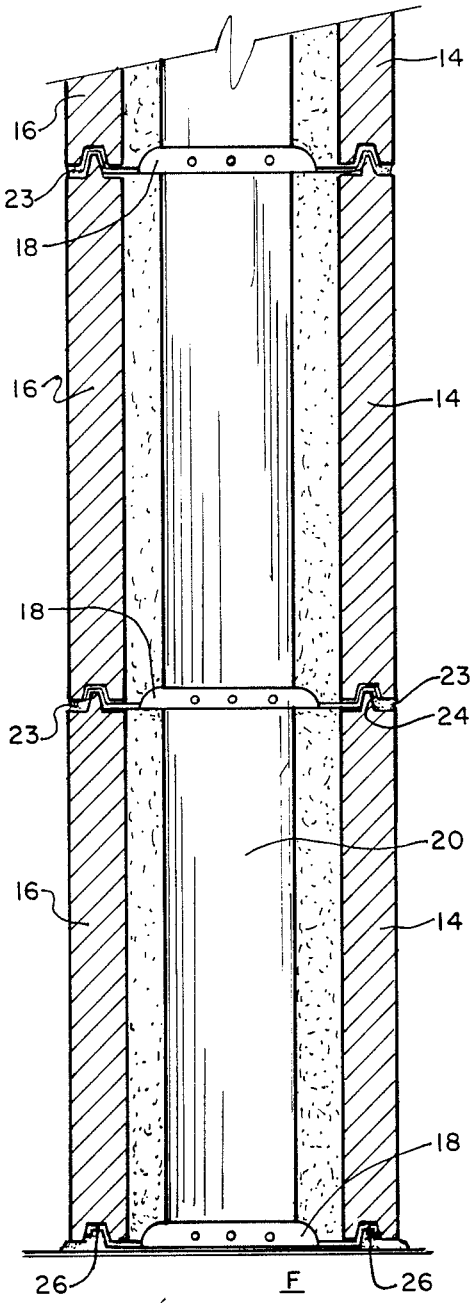
FIG. 3 is a cross sectional view taken along the lines 3—3 of FIG. 1.
Figure 4:
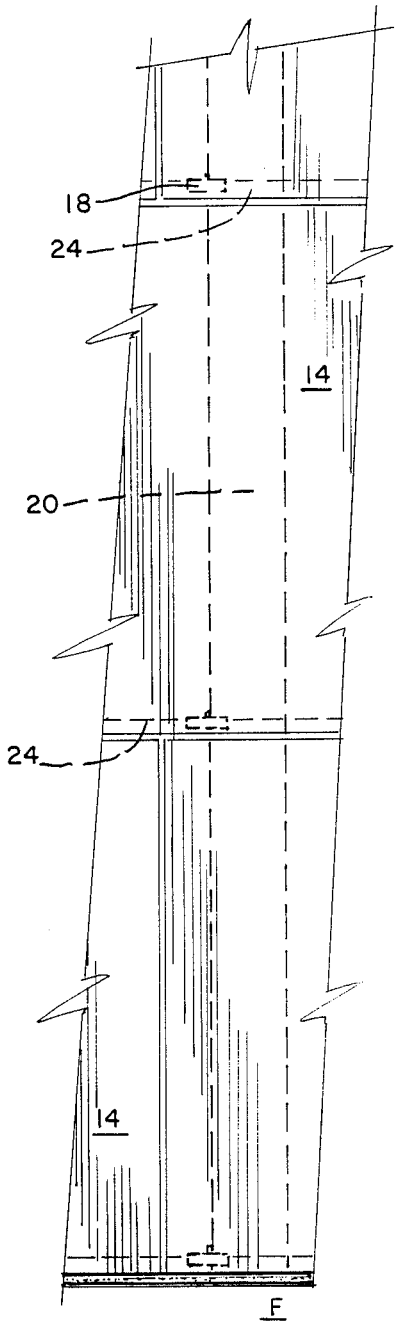
FIG. 4 is a side elevation view of the composite wall showing the reinforcing structure in phantom lines.
Figure 5:
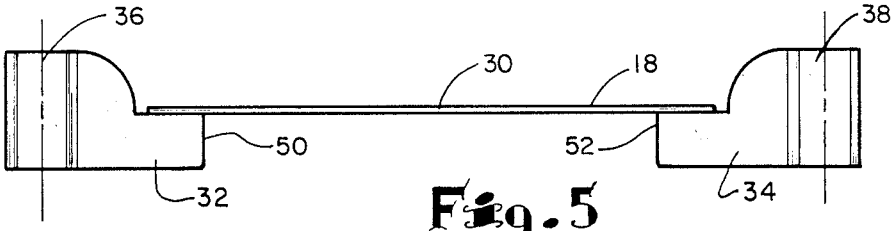
FIG. 5 is a top plan view of the cross tie bracket accord to the present invention.

The inside and outside panels 16, 14 are usually identical in construction but may have different surface finishes. Thus, the outside panels 14 can have an exposed aggregate type finish, a finish resembling woodgrain, or it can have bricks or tiles inset within the outer surface to give that type of appearance. The inside panels 16 may have a surface such as exposed aggregate, inset tile or brick or any other type of surface which would be suitable for inside finishes. The outer peripheral edges of the panel are formed with a suitable joint mechanism such as a mating tongue and groove configuration which will hold the individual panels in aligned position with the adjacent panels. In most cases, where a tongue and groove arrangement is provided a tongue 24 and complimenting groove 26 is provided each along two of the corresponding peripheral surfaces of each panel. Thus, as shown in FIG. 2 the tongue is provided along the upper horizontal surface of each panel and along the right edge in viewing the inside panel in FIG. 1. Accordingly, the remaining edges are formed with grooves 26 which are essentially sized the reverse of the tongue 24 so that they interfit and align with each other.

The tongue type of joint or key ridge can have sloped sides as seen in section to cause the panels to be self-aligned with minimum play as they are joined together during the construction. Usually a bead 23 of suitable caulking adhesive is applied to the outer edge of the tongue 24 prior to the stacking or positioning of the next adjacent panel. In this way, the panels are securely joined to each other and also include a weatherproof seal between panels to prevent the intrusion of water or other elements into the interior of the wall structure.

An extremely important element in the entire composite wall construction is provided by the cross tie bracket 18 which is unique in this type of structure. The bracket 18 is novel in that it is made inexpensively, usually from thin sheet material such as galvanized steel or aluminum which is bent and folded into the proper configuration. It is also possible that the bracket can be molded from any suitable plastic or synthetic resin such as polyvinylchloride, polypropylene or the like.

Figure 6:
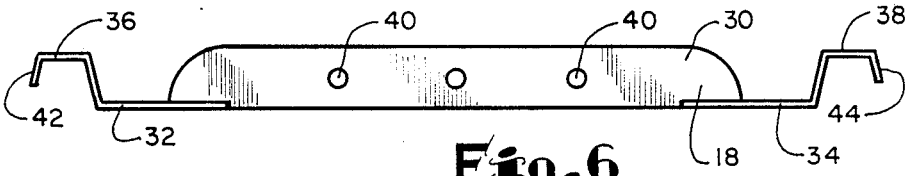
FIG. 6 is a side elevation view of the bracket.
Figure 7:
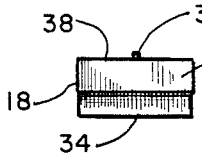
FIG. 7 is an end view of the bracket.
Figure 11:
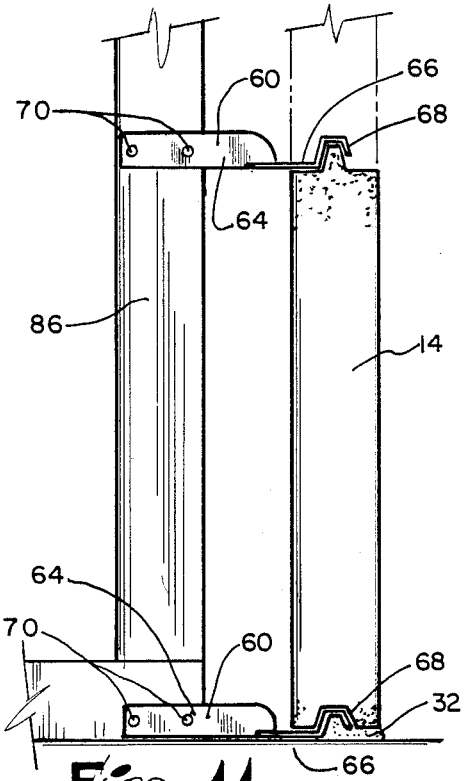
FIG. 11 is a cross sectional view showing another embodiment of the partial composite wall formed in conjunction with a reinforcing structural member.
Figure 12:
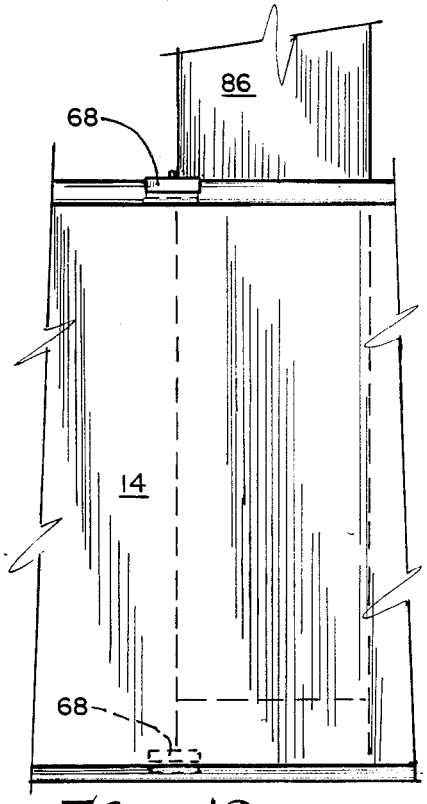
FIG. 12 is a side elevation view of the embodiment shown in FIG. 11.

The bracket 18 includes the body 30 and webs 32, 34 and hook members 36, 38. A number of apertures 40 such as the three shown in FIG. 6 are spacedly positioned along the length of the body section 30. If desired, these apertures 40 can be used to fasten the bracket 18 to the stud 20 by insertion of suitable fastener 26 such as screws or pop-rivets or by welding. The hook members 36, 38 are bent so as to conform with the outer surface dimensions of the tongue portion 24 of the panels 14, 16. The outer edges 42, 44 of the hook members are shortened to prevent their interfering with the joint provided between the panels and yet have a length which is sufficient to provide the necessary gripping force to hold the panel tongues 24. In addition, this allows the sealant bead to make total contact with the panel surfaces. It should be noted that the hook and web portions of the bracket 18 are arranged generally horizontal with the inner edges 50, 52 of the respective web portions 32, 34 cut to form a notch which has a width suitable to fit the nominal size of the stud used in the reinforcing structure. As can be seen, the bracket 18 is symmetrical on each side of the midpoint of the body section 30. Thus, the distance between the inside edges 50, 52 of the respective webs 32, 34 and the centerline of the hook sections 36, 38 are generally equal.

The bracket 18 engages and positions itself with respect to the stud 20 which accurately positions the upper edge of each panel a precise distance on each side of the wall reinforcing structure. In addition, the body portion 30 of the bracket 18 is turned or bent 90° with respect to the web portions 32, 34 so that the surface of the body will lie flush with the side surface of the stud 20. It is anticipated that one or more brackets will be used to tie the studs to the upper edges of each adjacent panel during the construction of the composite wall. A separate advantage which is provided by the vertical positioning of the body section 30 of the bracket 18 is the reduction in horizontal projected surface area so that a minimum resistance or impediment will be imparted to the flow or expansion of any filler material which might be introduced in the cavity provided in the interior of the composite wall. Thus, a minimum force is applied to the bracket which otherwise could shift the position of the panels during the filling process.

The construction of the composite wall is initiated by positioning a base plate 22 on the foundation F. The center portion 30 of a plurality of brackets 18 can be flattened and attached to the bottom surface of the plate 22 so that the hook portions 36, 38 are equally spaced on either side of the plate 22. The vertical studs 20 are attached to the cap and equally spaced as required for the type of structure being formed. An upper plate (not shown) is attached to each of the upper ends of the vertical studs 20 to tie the reinforcing structure together in a rigid configuration. If necessary, this structure can be reinforced by diagonal bracing or other type of support in the interim while the composite wall is being built.

The first course of precast building panels 14, 16 are then positioned on one or both sides of the reinforcing structure with the bottom groove of each panel positioned so as to fit over the hook members 36, 38 respectively on the positioning brackets 18. Additional brackets 18 are used to tie the upper edges of this course of panels with the brackets fastened to the adjacent studs 20. Once the first course is completed the interior space between the panels 14, 16 and surrounding the plate 22 and base of studs 20 is filled with a suitable setting material such as light-weight concrete. In this way, the base course of the wall is rigidly held in position which will provide additional support for the reinforcing wall structure. The composite wall according to the present invention is then constructed merely by stacking either in vertically aligned or staggered position the second and later courses of panels. A bead of sealant adhesive is applied between the edges of each panel and at least one bracket 18 holds the upper edge of each panel in position with respect to an associated stud.

After two or three courses or tiers of panels have been positioned on each side of the reinforcing structure the interior cavity between the completed courses can be filled with a suitable hardenable, bonding material such as polyurethane foam which expands into any grooves or depressions, and bonds with the rear surface of each of the panels and the framework. Preferably the back surfaces of the panels are distressed or roughened to facilitate and greatly enhance the bonding capability of any filler material selected. By the same token, it is possible that the hardenable filler 31 can be light-weight concrete or any other suitable filler which is desired for the intended purpose. It is to be noted that throughout this construction there is no necessity for loops to be provided on the rear surface of the panels nor is there a necessity for the tying of the panels individually with tie wires and blocks which is characteristic of the construction which has been performed in the past. This progressive construction is continued until the desired height of the wall is obtained.

In actual construction, it is anticipated that the filler 31 will extend to within approximately 10 to 12 inches of the upper edge of the topmost panel with the remaining void filled with settable concrete in which reinforcing rods and anchor bolts are positioned to complete the wall structure. After the filler has set, construction plates can be attached to the upper edge of the wall by the anchor bolts in order to tie the new building structure together with the newly formed composite walls.

The composite walls as described herein are self-standing and exceed all known building codes for industrial, residential or commercial use. It will hold a liquid static head pressure internally of at least 8 feet of settable concrete in one pour. Although cellular concrete or light-weight concrete can be used as the filler for the interior of the walls, it is in most cases desirable to provide some type of suitable expanding foam to provide a substantial insulating factor. Thus, a composite wall constructed according to the present invention by using a suitable foam filler can provide an energy conserving structure which is even better than solid masonary structures which have been considered excellent in the past.

It is to be understood that while a permanent type of filled composite wall structure has been described it is possible that the wall can be built for temporary use, if desired. In this mode the brackets can be secured or left unsecured with respect to the reinforcing studs and the filler can be dirt, sand or any other material which will dampen the wall from vibration or impact but still be easy to remove and dispose. By the same token, the wall can be left hollow and unfilled if this approach is preferred.

In some cases it is desirable to construct a concrete surfaced composite wall adjacent a building structure or to a wall of an existing structure. Thus, it is possible to panel resurface or add to a structure utilizing a portion of the structure which has been described for the complete composite wall.

In this embodiment the tie brackets 60 which can be identical to the original brackets 18 are modified by removing the web and hook portion from one end of the bracket. In this way, the body portion 64, 66 and hook portion 68 will comprise the modified bracket 60. Apertures 70 will be provided in the body section 60 for attaching the bracket to the framework or an existing wall surface or existing wall structure.

Figure 8:
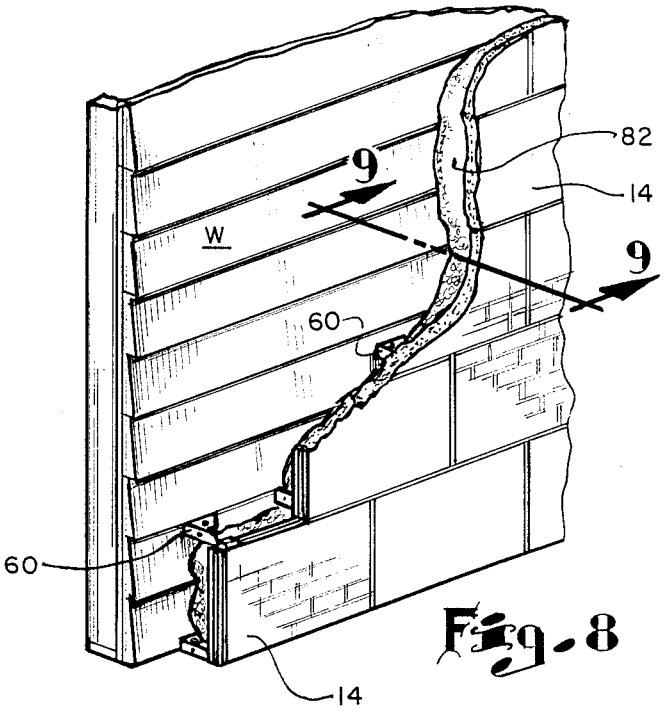
FIG. 8 is a perspective partial cutaway view of one-half of the composite wall built in conjunction with an existing wall structure.
Figure 9:
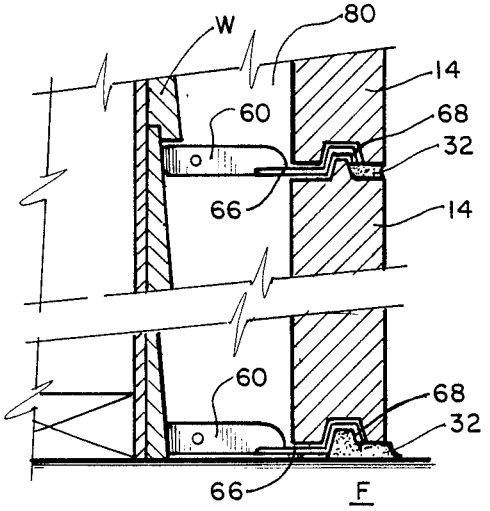
FIG. 9 is a partial cross sectional view taken along the lines 9—9 of FIG. 8.
Figure 10:
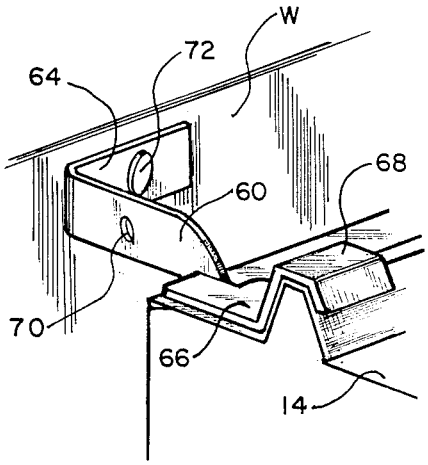
FIG. 10 is a partial perspective view showing the partial bracket used in this embodiment of the composite wall.

With an existing wall structure as shown in FIG. 8 the body section 64 of the bracket 60 can be cut and bent so as to provide a predetermined distance between the centerline of the hook section 68 and the wall surface W. Suitable fasteners 72 are utilized to attach the bent portion of the body section 64 to the surface at the desired location. The panels 14 are then stacked as previously described with the adhesive bead placed between the edges of each of the panels.

In this way, a suitable concrete wall surface is applied to the outer surface W of the existing structure with the panels 14 spaced the desired distance from the existing structure to form the cavity 80 between the existing wall and the building panels. Once the outer wall formed by the panels 14 has been completed the space 80 is filled with a suitable filler 82 such as light-weight concrete or expandable foam. It is anticipated that the upper edge of the wall will be finished as previously explained with the new construction tied with the existing structure.

Where it is desired to form the outer wall panels adjacent to an existing reinforcing structure the brackets 60 can have the body portion 64 either left straight or bent as desired with the bracket 60 attached to the existing studs 86 forming the existing reinforcing structure. The inside edge of the web 66 can be used to provide the proper spacing for the hook member 68 with respect to the existing stud 86 or the hook member can be positioned at any distance desired from the existing structure. In this way, the outer wall panels 14 are easily stacked and held in position by use of the brackets 60. The filler which is introduced in the cavity will completely fill the void between the studs, interior wall surface and the outer wall panels 14 to rigidly join and secure the panels 14 in the proper position.

While a tie bracket, a composite wall structure and a method for making the wall are shown and described in detail in this application, it is to be understood that this invention is not to be considered to be limited to the exact form disclosed and changes in the detail and construction of the composite wall or bracket may be made without departing from the spirit thereof.

I claim:

1. A reinforced composite wall structure comprising:

(a) a framework means formed from a number of structural members arranged generally vertical and spaced from each other, said structural members being joined together by cross members to form a rigid structure, said framework means being arranged to be fixedly anchored to a supporting structure;

(b) a single wall surface formed from stacked preformed concrete building panels, each panel having interlocking means formed along each peripheral edge whereby as the panels are stacked one upon the other to form said wall surface the interlocking means holds each panel secure with the associated panels to form the integral wall surface, a space being formed between said wall surface and said framework means; and (c) a plurality of cross tie brackets arranged to interconnect and hold the edge of each of said wall panels to properly support and align said panels with respect to said framework means, said cross tie brackets having positioning means for contacting and being fastened to said framework means whereby the wall surface is held a predetermined distance from said framework means so that the wall surface is properly positioned with respect to the framework means whereby the entire composite wall structure can be positioned in place and fixedly anchored to said supporting structure.

2. A reinforced composite wall structure as defined in claim 1 wherein the rear surface of said wall panels and said framework means are covered with a hardenable material capable of bonding said panels and said framework means into a rigid composite wall structure.

3. A reinforced composite wall structure comprising:

(a) a framework means formed from a number of structural members arranged generally vertical and spaced from each other, said structural members being joined together by cross members to form a rigid structure, said framework means having cap members attached at the top and bottom of said plurality of generally vertical members whereby the entire structure is held together as a rigid frame, said framework means being located and anchored to a supporting structure;

(b) a pair of inside and outside walls each formed from a plurality of stacked preformed concrete building panels, each panel having interlocking means formed along each peripheral edge whereby as the panels are stacked one upon the other the interlocking means holds each panel secure with the associated panels to form an integral wall surface, said interlocking means is formed as a tongue and groove joint mechanism whereby mating surfaces will have the opposite configuration, the tongue and groove members are formed with tapered sides whereby the edges of the panels will slidably fit together to form a positive joint, said preformed walls being positioned on each side of said framework means and having a space formed between said walls and the enclosed framework means;

(c) a plurality of cross tie brackets formed from sheet material and having a hook member formed at each end, said hook members being sized to fit the tapered tongue and groove portion of the interlocking means on each corresponding panel to properly support and align said wall panels, said hook members being sized to fit the tapered tongue and groove portion of the interlocking means on each corresponding wall panel, said cross tie brackets further having a central notch sized to fit the width of the vertical members forming the framework means whereby the notch will fit the framework means to properly position the inside and outside wall surfaces with respect to said framework means, the central portion of the associated cross tie bracket being fixedly anchored to the adjacent framework means to lock the wall panels in position; and (d) the space between said inside and outside walls and framework means is filled with an expandable, settable foam material which will impart desirable insulation characteristics to the wall and permanently bond said preformed panels and framework means into a rigid composite wall structure.

4. A reinforced composite wall structure having a single wall surface spaced from an existing support structure, the wall structure comprising:

(a) a plurality of preformed building panels having interlocking edge means being stacked horizontally and vertically with respect to said support structure so as to form a single wall surface, each of said wall panels having a tongue and groove joint arrangement;

(b) a plurality of cross-tie brackets being attached to said existing support structure and arranged to extend perpendicular to the surface of said support structure a predetermined distance, said cross-tie brackets having means at the outer end to suitably grip the tongue and groove edge of a corresponding building panel whereby the panel edge will be held rigid in a predetermined spaced position from and in alignment with respect to said structure; and (c) the surface of said building panels nearest said support structure is coated with a layer of expandable hardenable foam which bonds the panels and the structure together to add substantial strength to the wall structure and provide a heat insulating effect.

* * * * *